US007125310B1

(12) United States Patent
Van Dan Elzen

(10) Patent No.: US 7,125,310 B1
(45) Date of Patent: Oct. 24, 2006

(54) YO-YO HAVING REPLACEABLE DISKS

(76) Inventor: Hans W. Van Dan Elzen, 4750 S. Stallion Dr., Gilbert, AZ (US) 85297

( * ) Notice: Subject to any disclaimer, the term of this patent is extended or adjusted under 35 U.S.C. 154(b) by 0 days.

(21) Appl. No.: 11/117,747

(22) Filed: Apr. 27, 2005

(51) Int. Cl.
*A63H 1/30* (2006.01)

(52) U.S. Cl. ..... 446/250; 446/247

(58) Field of Classification Search ..... 446/247–254
See application file for complete search history.

(56) References Cited

U.S. PATENT DOCUMENTS

| | | | | |
|---|---|---|---|---|
| 4,207,701 | A * | 6/1980 | Kuhn | 446/250 |
| 5,254,027 | A * | 10/1993 | McAvoy, Jr. | 446/250 |
| 5,389,029 | A | 2/1995 | McAvoy, Jr. | |
| 6,080,035 | A * | 6/2000 | Pekarsky et al. | 446/250 |
| 6,113,456 | A | 9/2000 | Hadzicki et al. | |
| 6,142,850 | A | 11/2000 | Levy | |
| 6,162,109 | A * | 12/2000 | Baier | 446/250 |
| 6,206,749 | B1 | 3/2001 | Bell | |
| 6,220,920 | B1 * | 4/2001 | Baier | 446/250 |
| 6,254,452 | B1 | 7/2001 | Adler | |
| 6,331,132 | B1 * | 12/2001 | Watson | 446/250 |
| 6,533,636 | B1 | 3/2003 | Holenstein et al. | |
| 6,579,142 | B1 * | 6/2003 | Rehkemper et al. | 446/247 |
| 6,599,165 | B1 * | 7/2003 | Van Dan Elzen | 446/250 |

FOREIGN PATENT DOCUMENTS

| | | | |
|---|---|---|---|
| DE | 19731087 | A1 | 2/1998 |

* cited by examiner

*Primary Examiner*—Eugene Kim
*Assistant Examiner*—Alyssa M. Lowen
(74) *Attorney, Agent, or Firm*—Franklin Gubernick

(57) ABSTRACT

The invention is an improved yo-yo that features unique multi-piece sides. Each side has a removable disk that functions to affect the yo-yo's responsiveness via one or more tether engagement structures that can be contacted by the yo-yo's tether. When the removable disk is made of a resilient material, the disk can be compressed to change the yo-yo's responsiveness. Each removable disk may also form the associated side's rim and thereby functions to substantially define the side's shape. By replacing one set of removable disks with another, a user can quickly and easily change the yo-yo's shape and/or rim material and/or responsiveness.

28 Claims, 9 Drawing Sheets

YO-YO HAVING REPLACEABLE DISKS

FIELD OF THE INVENTION

The invention is in the field of user-manipulated toys. More particularly, the invention is an apparatus in the form of a yo-yo in which each of the yo-yo's side portions preferably includes a replaceable disk. The disk functions to affect the yo-yo's responsiveness via at least one tether engagement member that can be contacted by the tether. The replaceable disk may also form the side portion's rim. By replacing one set of replaceable disks with another, a user can quickly and easily change the yo-yo's shape and/or rim material and/or responsiveness. Each side portion preferably also includes a fastening system that releasably secures the replaceable disk, is easily operated without the need for tools, and in some cases can be used to adjust the yo-yo's responsiveness.

BACKGROUND OF THE INVENTION

Most yo-yos are in the form of two disk-shaped side portions that are rigidly connected to each other by some form of axle structure. The side portions are usually of unitary construction and are made out of plastic, metal or wood. The axle structure is secured to the center of both side portions and may be an assembly of multiple parts, or merely be in the form of a dowel or a riveted pin. In many modern yo-yos, the axle structure includes a center-located bearing or other member that is secured to, and rotatable on, an elongated axle pin.

The axle structure also forms an anchor for one end of a string-type tether. An end-located loop portion of the tether is positioned so that it encircles a center portion of the axle structure. The free end of the tether is usually tied to create a second loop portion that can be placed about one of a user's fingers to thereby secure the yo-yo to the user's hand.

When the tether is wound about the axle structure and the yo-yo is released, or thrown, from the user's hand, the yo-yo will begin to rapidly spin as it moves away from the user's hand and the tether unwinds from the axle structure. Once the tether is fully unwound, the yo-yo may "sleep" at the end of the tether, whereby the yo-yo's side portions continue to spin without the tether rewinding on the axle structure. Once the yo-yo is sleeping, there are a number of tricks, such as "walk the dog," that a person can perform with the spinning yo-yo. A sleeping yo-yo is also often used to perform tricks that involve temporarily placing the spinning yo-yo onto a portion of the tether intermediate of the tether's two ends.

At the completion of most yo-yo tricks, the user will make a quick tug/jerk on the tether. This will result in a brief tightening of the tether, which is then automatically followed by a temporary slackening of the tether. Once the tether goes slack, the tether's twist will cause one or more portions of the tether located proximate the axle structure to move, and thereby contact, a spinning portion of the yo-yo. Once contact has occurred, the tether portion can become locked to a spinning portion of the yo-yo in a manner whereby rotation of the spinning portion of the yo-yo causes the tether to wind about the axle structure. Winding of the tether on the axle structure makes the yo-yo return to the user's hand.

Every yo-yo has three crucial performance characteristics that determine the yo-yo's ability to perform tricks. They are the yo-yo's potential sleep time, its ability to return on command, and whether the yo-yo is smooth on the tether.

Concerning a yo-yo's sleep time, the longer the yo-yo can be made to sleep, the more time the user will have to complete any particular yo-yo trick. It is well known that by minimizing friction in the yo-yo's components, one can maximize the yo-yo's sleep time. Furthermore, it is known that whenever the tether even slightly rubs against a spinning portion of the yo-yo, the created friction will reduce the yo-yo's sleep time.

For a yo-yo to return on command, the structure and design of the yo-yo must be such that when the user causes the tether to briefly go slack, a portion of the tether can become locked to a spinning portion of the yo-yo in a manner whereby the yo-yo is caused to return to the user's hand. In most prior art yo-yos, the ability for the tether to become locked to a spinning portion of the yo-yo is usually enhanced through the use of engagement adaptations, such as raised ribs, located on an inner portion of the tether-facing surface of both of the yo-yo's side portions. The tether-facing surface of a side portion is herein defined as the surface of the side portion that faces a portion of the yo-yo's tether when said tether extends straight out from the yo-yo's string gap area. A yo-yo's string gap area is herein defined as the area located between the yo-yo's side portions. The ability of a yo-yo to return on command is also the common measure of a yo-yo's responsiveness.

Concerning a yo-yo's ability to be smooth on the tether, this refers to a yo-yo's ability, when it is sleeping at the end of the tether, to be temporarily placed on a medial portion of the tether without the tether becoming locked to a spinning portion of the yo-yo. An example of a trick that requires a yo-yo to be smooth on the tether is "man on the trapeze." If, during such a trick, the yo-yo can slide on the tether, the yo-yo is said to be very smooth on the tether/string. The ability of a yo-yo to be smooth on the tether is favored when the yo-yo's responsiveness is low. A yo-yo with an overly high responsiveness will transform even the slightest contact between the tether and a spinning portion of the yo-yo into an inadvertent rapid return of the yo-yo to the user's hand. When such an inadvertent return happens, the performance of a yo-yo trick will usually be cut short and thereby ruined.

Over the years, many different shapes have been employed for the yo-yo's side portions. Traditional yo-yos will usually feature substantially planar side portions that have a bulge in the area of the rim to provide an improved weight distribution that increases spin time and stability. Butterfly yo-yos feature side portions that are stretched outwardly, away from the center of the yo-yo, thereby increasing the width of the yo-yo and giving the yo-yo a butterfly shape when viewed in cross-section.

It is also known to use different materials for, or on, the rim portion of each of a yo-yo's side portions. For example, while most yo-yos have rim portions made of a hard plastic material, it is known to employ rubber either as the rim material, or in the form of an o-ring that is placed on the periphery of each of a yo-yo's side portions.

The different shapes and materials employed in a yo-yo's side portions not only make the yo-yo distinctive, they also affect the yo-yo's performance. For example, a user performing looping tricks with a yo-yo will usually prefer a traditionally shaped yo-yo that has substantially planar side portions. Such a shape is best at looping since the weight distribution is close to the tether's attachment point on the yo-yo, thereby enabling the yo-yo to flip over relatively easily during each loop. For yo-yo tricks in which the user attempts to catch the spinning yo-yo on a medial portion of the tether, a butterfly shaped yo-yo is preferred. The more widely spaced-apart side portions improve the yo-yo's stability whereby the yo-yo is less prone to tilt off the tether. Furthermore, the wider stance of a butterfly-shaped yo-yo facilitates a user being able to land the yo-yo on a medial portion of the tether.

To take advantage of the different yo-yo performance characteristics provided through the use of side portions of different shapes and/or materials and/or that have different tether engagement adaptations, many experienced yo-yo players will own a large variety of different yo-yos. This enables the player to pick a yo-yo from his or her collection that will work best for the particular trick(s) that the player wishes to perform. However, the costs involved in buying and maintaining a large number of yo-yos can be considerable. In addition, transporting a large number of yo-yos can be bothersome and is usually accomplished using a bulky and expensive transport case specially adapted for carrying yo-yos.

SUMMARY OF THE INVENTION

Like most other yo-yos, a yo-yo in accordance with the invention includes a central axle structure that connects together the yo-yo's two side portions in a spaced-apart relation. However, unlike most other yo-yos, a yo-yo in accordance with the invention has side portions that are an assemblage of parts and wherein each includes a replaceable disk that can affect the yo-yo's performance.

In the preferred embodiment, each of the yo-yo's side portions comprises a hub to which the axle structure is connected, and a replaceable disk secured to an outwardly-facing surface of said hub. The replaceable disk includes at least one tether engagement member that faces, or extends into, the yo-yo's string gap area to thereby affect the yo-yo's responsiveness, potential sleep time, and ability to be smooth on the tether. By having the tether engagement member extend through the hub, the replaceable disk is prevented from rotating relative to the hub. The peripheral portion of the disk preferably functions as the side portion's rim and can at least partially define the ultimate shape of the side portion.

The replaceable disk is preferably made of a rubber or plastic material. The rim portion of the disk may be of any desired shape whereby the use of a particular set of disks can cause the yo-yo to have a diablo-type shape, a conventional shape, a butterfly shape, or any other preferred yo-yo shape.

In the preferred embodiment, each of the yo-yo's side portions also includes a support disk and a securement member. The support disk fits against an outwardly-facing side surface of the replaceable disk and is non-rotatably engaged to the replaceable disk. The securement member is engaged to a portion of the hub and sandwiches the support disk between itself and the replaceable disk. The support disk functions to distribute the inwardly-directed force applied by the securement member when said member is tightened to secure the replaceable disk in place. The support disk also acts to prevent rotational forces from being applied directly onto the replaceable disk when the securement member is rotated. In the preferred embodiment, the securement member includes large shaped grooves in its outwardly-facing surface that are easy to grasp and thereby enable a user to rotate said member without the need for tools.

To prevent the securement member from inadvertent rotation, a multi-detent system is employed between the securement member and the support disk. The system causes the final rotations of the member to be preferably accompanied by a clicking sound as the securement member lockingly engages the support disk multiple times per revolution.

By replacing one set of replaceable disks with another, a user can quickly and easily change the yo-yo's shape and/or rim material and/or responsiveness. For example, the yo-yo can initially be set for looping whereby it features replaceable disks that give the yo-yo's side portions a substantially planar configuration, with each having at least one tether engagement member adapted to provide the yo-yo with a high level of responsiveness. To make the yo-yo ideal for string tricks, a user can quickly and easily remove the yo-yo's replaceable disks and attach different replaceable disks that convert the yo-yo into a butterfly shape with tether engagement members that cause the yo-yo to have a low to moderate level of responsiveness. As another alternative, a user can replace one set of replaceable disks with another wherein the first set of replaceable disks have hard rim portions, and the replacement replaceable disks have rim portions made of a soft resilient material.

When the replaceable disks are made of a resilient material such as rubber, a user can adjust the yo-yo's responsiveness via a tightening of one, or both, of the yo-yo's securement members. Since the replaceable disks are compressible, tightening of the securement members cause the replaceable disks to be compressed. Compression of the disks causes an end portion of each one's tether engagement member(s) to move closer to said tether and thereby increase the yo-yo's responsiveness.

In a second embodiment of the invention, the tether engagement member(s) are located on a replaceable engagement disk and a replaceable rim disk is employed to form the side portion's rim. In this embodiment, a user can easily change the yo-yo's performance characteristics by replacement of one, or both, of a each side portion's replaceable disks.

The invention is therefore a yo-yo having side portions that can be easily modified by a user without the need for special tools. Modification of the side portions enables the yo-yo to be optimized for different types of tricks, thereby enabling the yo-yo to effectively take the place of multiple yo-yos. This negates the need for the user to own, maintain and transport multiple yo-yos. In addition, a user modifiable yo-yo, as taught herein, can provide increased interest to a user through the yo-yo's extended range of usability and the player's ability to decide on the best manner in which to modify the yo-yo for the performance of particular tricks.

DETAILED DESCRIPTION OF THE DRAWINGS

Figure 1:
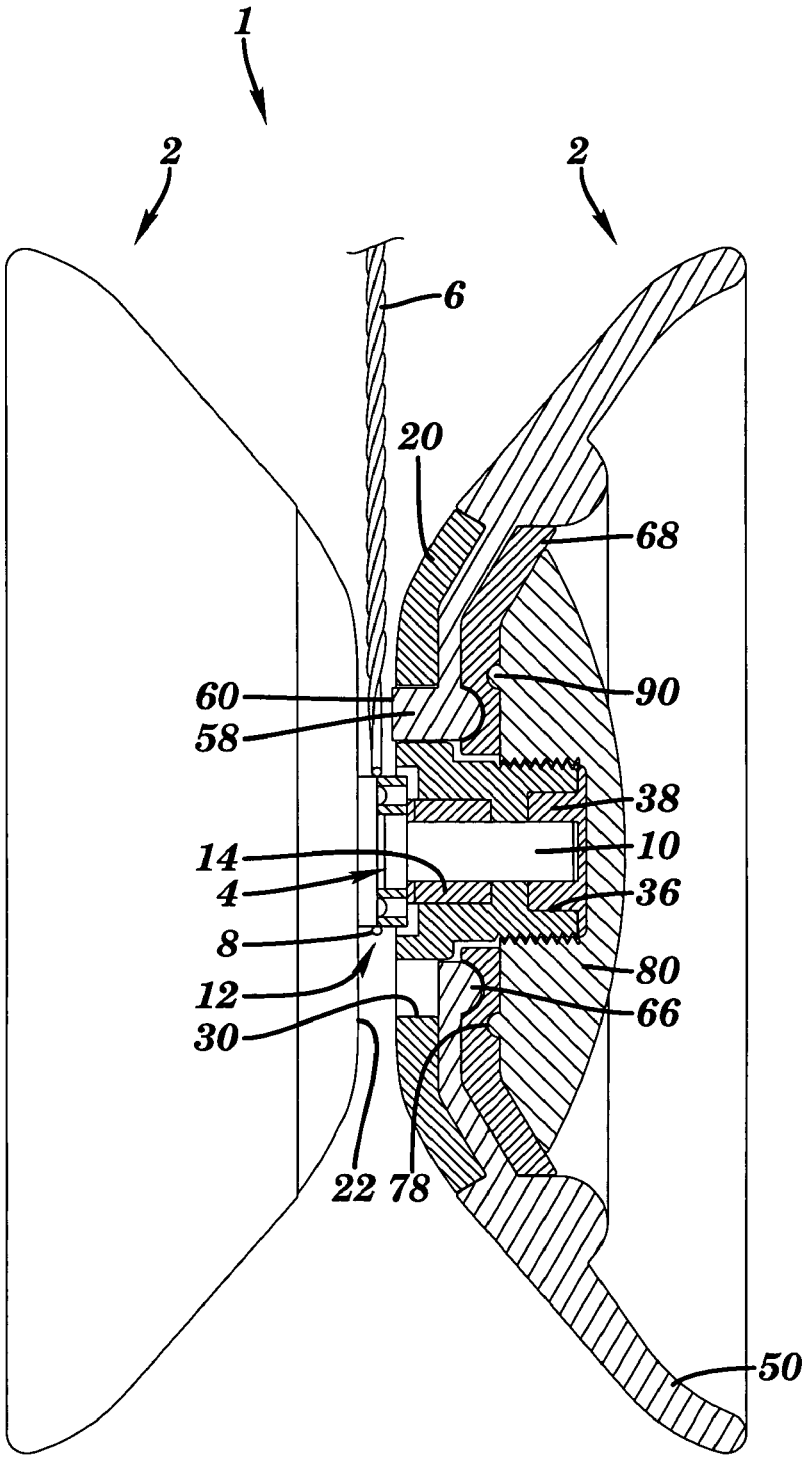
FIG. 1 is a front view of a first embodiment of a yo-yo in accordance with the invention, with the right-hand portion of the yo-yo shown in cross-section.

Looking now to the drawings in greater detail, wherein like reference numerals refer to like parts throughout the several figures, there is indicated by the numeral 1 a yo-yo in accordance with the invention.

The yo-yo 1 includes first and second side portions 2 that are preferably identical and are connected together via an axle structure 4. A string-type tether 6 includes a loop portion 8 that encircles a center portion of the axle structure. The tether's distal end (not shown) will normally be tied to create a loop to enable a temporary securement of said end to one of a user's fingers.

Figure 2:
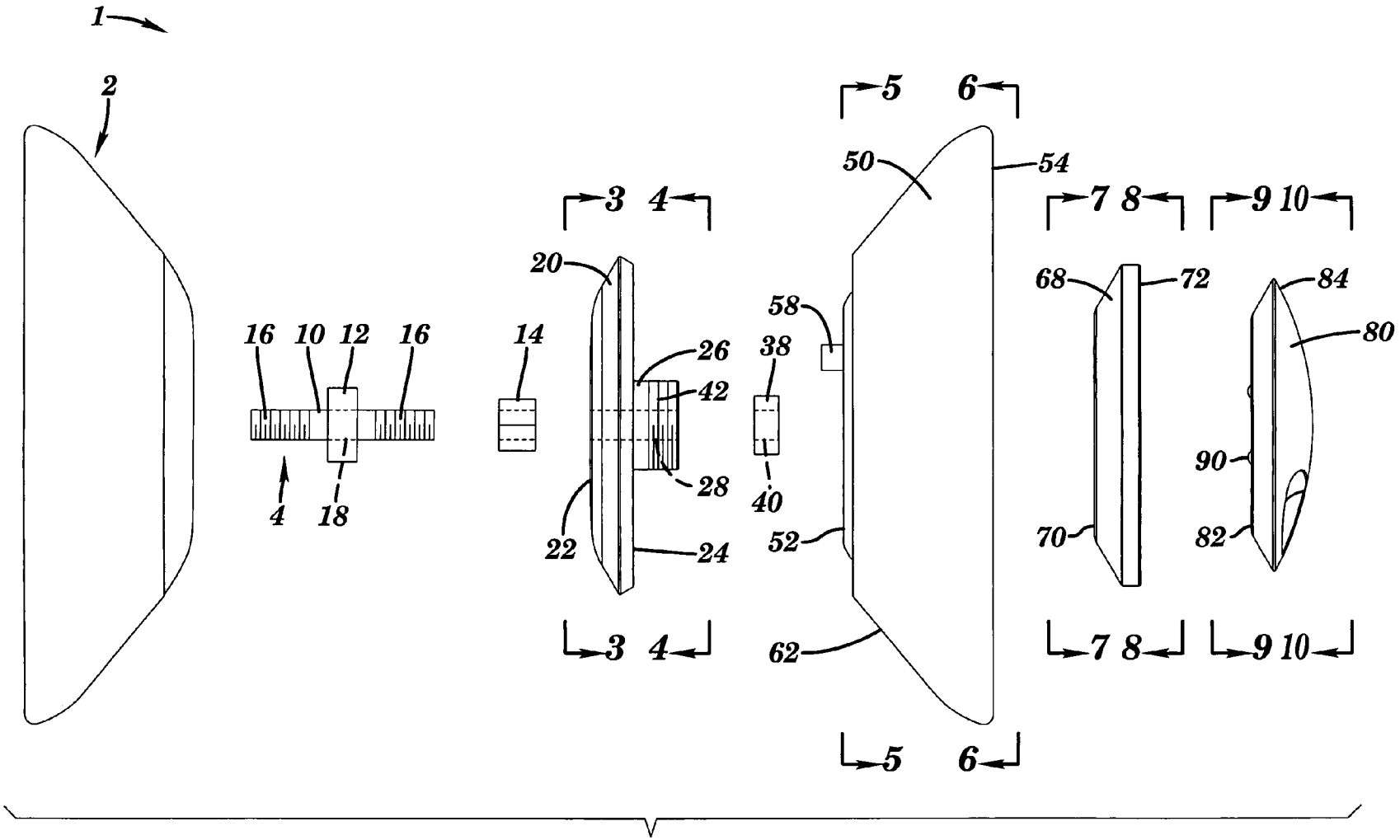
FIG. 2 is a front view of the yo-yo shown in FIG. 1, with the right-hand portion shown in exploded fashion.
Figure 4:
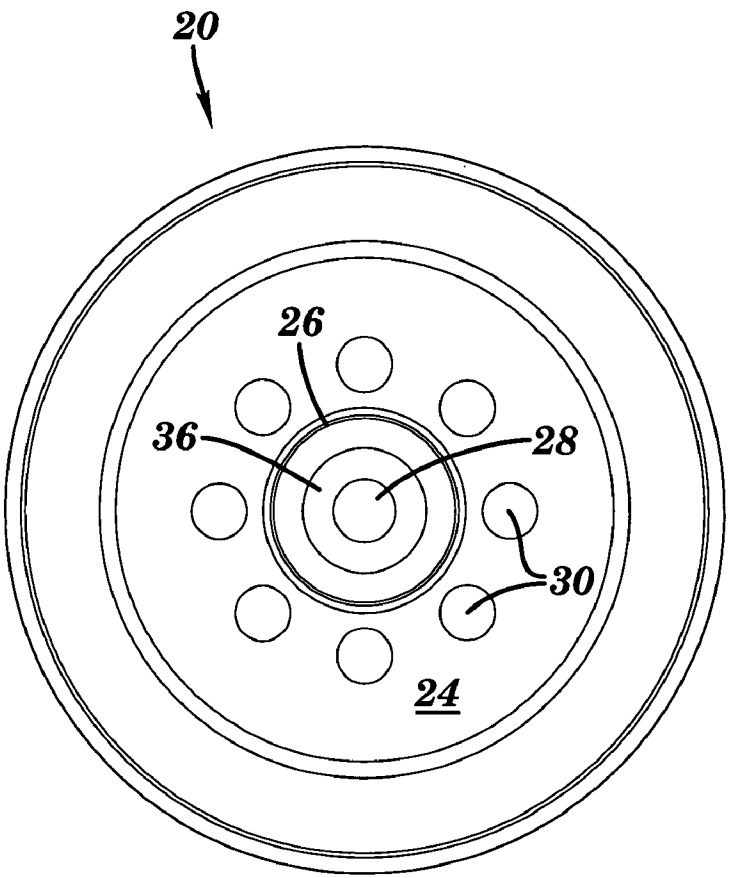
FIG. 4 is a side view showing the outwardly-facing surface of the hub shown in FIG. 3, taken at the plane labeled 4—4 in FIG. 2.
Figure 3:
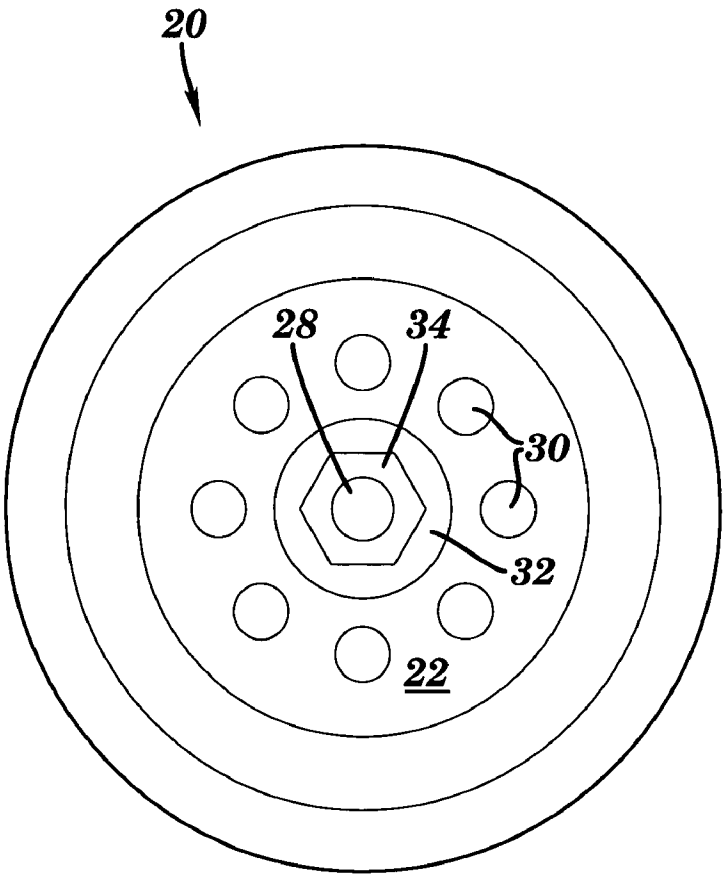
FIG. 3 is a side view showing the tether-facing surface of one of the hubs of the yo-yo shown in FIG. 1, taken at the plane labeled 3—3 in FIG. 2.
Figure 6:
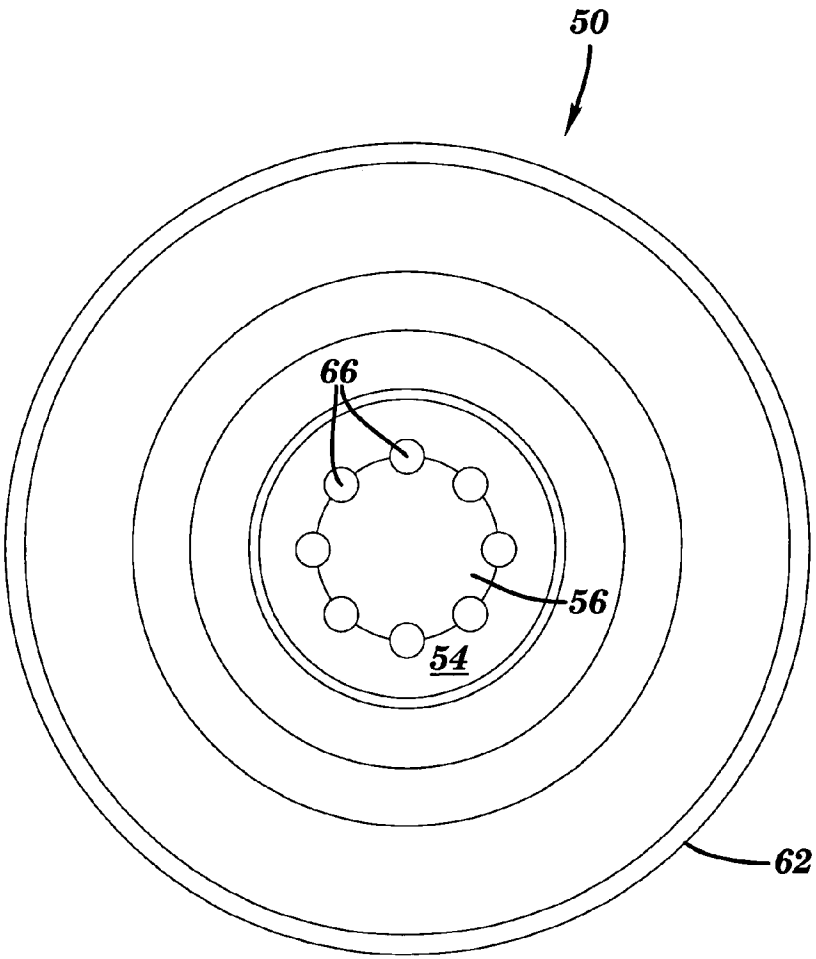
FIG. 6 is a side view showing the outwardly-facing surface of the replaceable disk shown in FIG. 5, taken at the plane labeled 6—6 in FIG. 2.
Figure 5:
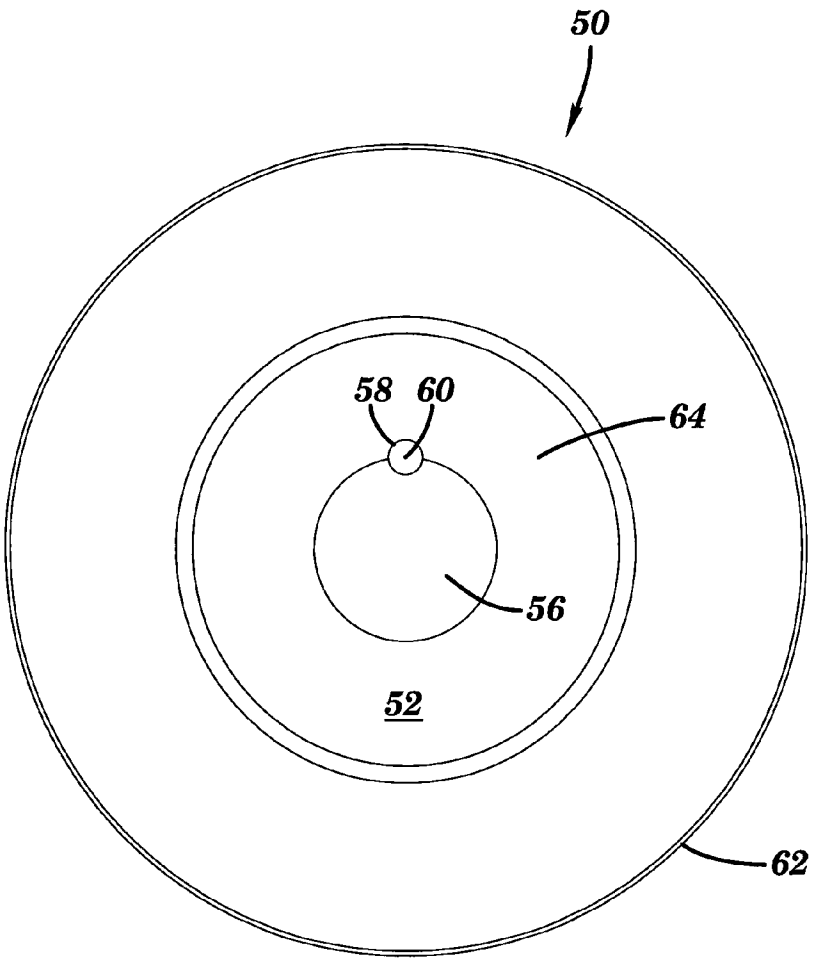
FIG. 5 is a side view showing the inwardly-facing surface of one of the replaceable disks of the yo-yo shown in FIG. 1, taken at the plane labeled 5—5 in FIG. 2.
Figure 8:
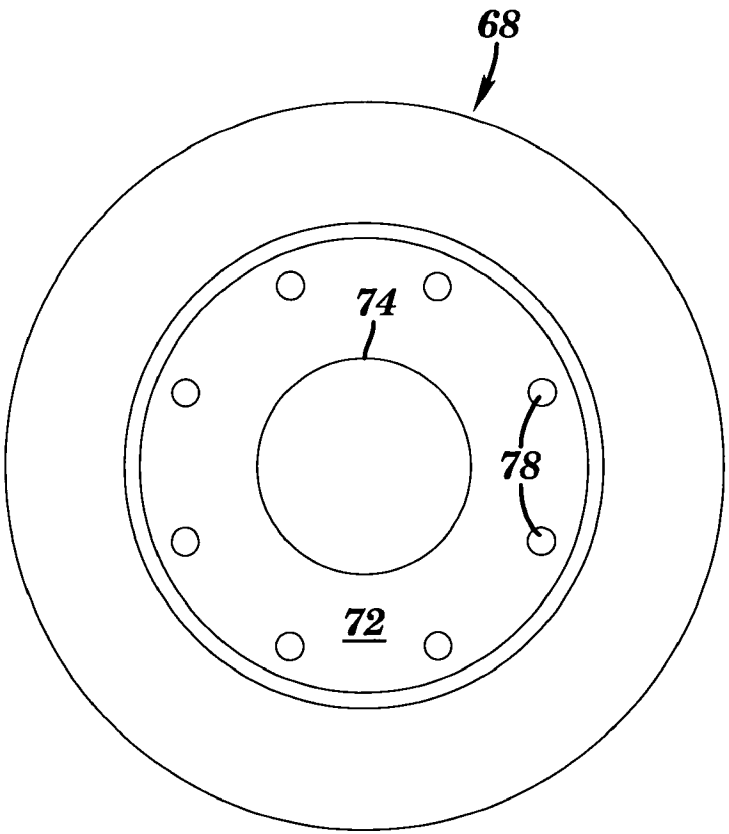
FIG. 8 is a side view showing the outwardly-facing surface of the support disk shown in FIG. 7, taken at the plane labeled 8—8 in FIG. 2.
Figure 7:
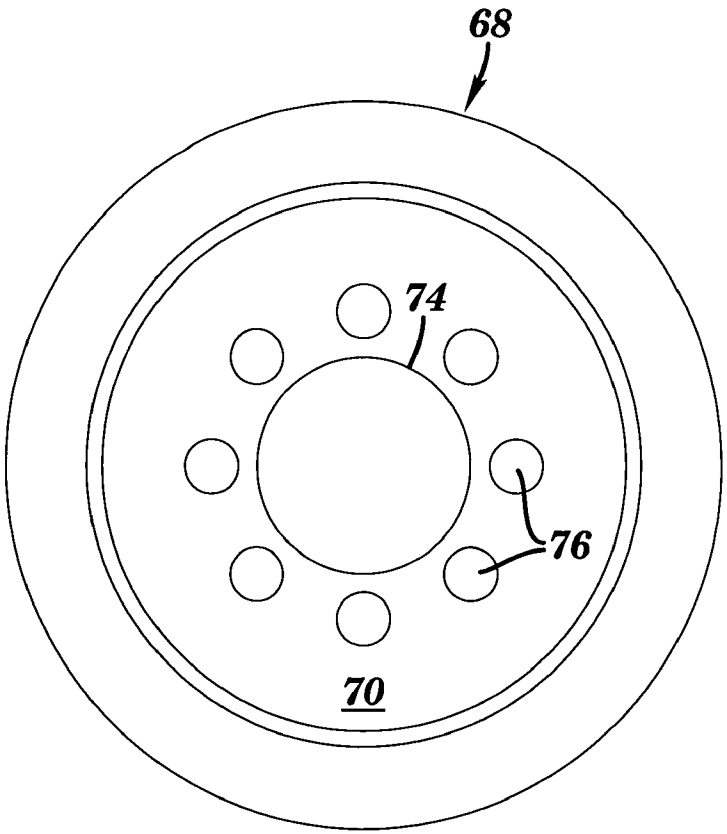
FIG. 7 is a side view showing the inwardly-facing surface of one of the support disks of the yo-yo shown in FIG. 1, taken at the plane labeled 7—7 in FIG. 2.
Figure 10:
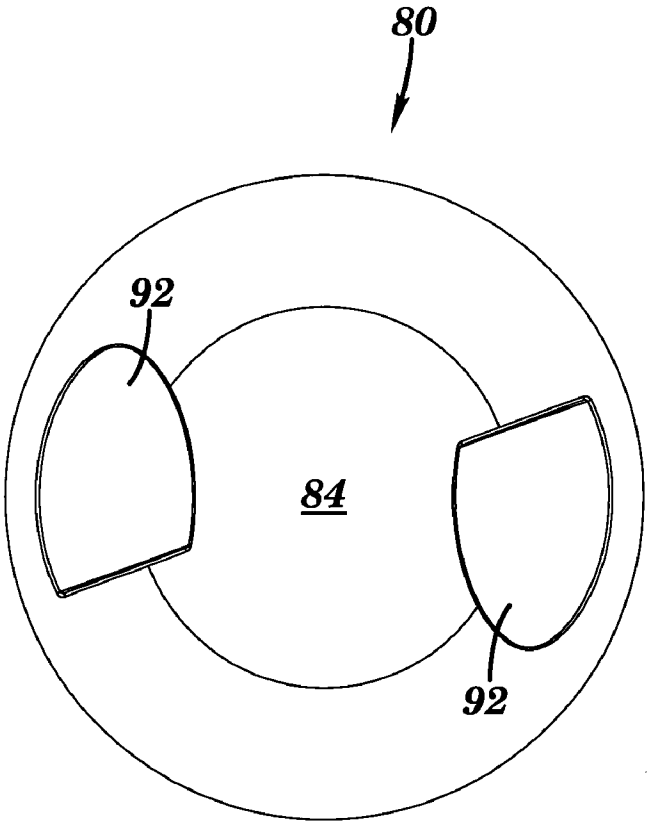
FIG. 10 is a side view showing the outwardly-facing surface of the securement member shown in FIG. 9, taken at the plane labeled 10—10 in FIG. 2.
Figure 9:
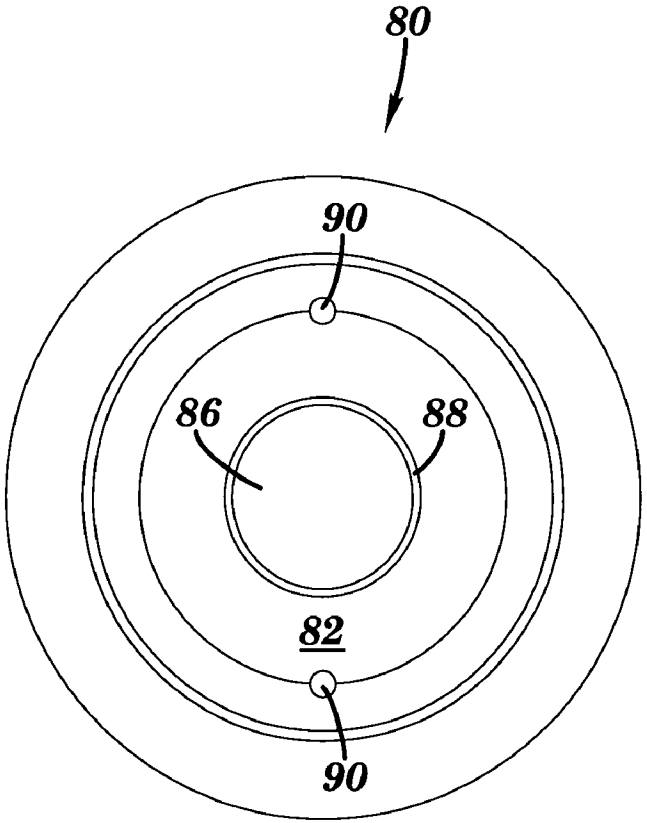
FIG. 9 is a side view showing the inwardly-facing surface of one of the securement members of the yo-yo shown in FIG. 1, taken at the plane labeled 9—9 in FIG. 2.

The axle structure 4 is preferably an assemblage of parts (note FIG. 2) that includes an axle pin 10 and a ball-bearing unit 12. The axle pin has a longitudinal axis co-linear with the yo-yo's axis of rotation. The ball bearing unit is sandwiched between two hex nuts 14 (the nut in the left-hand side portion is not shown) that are threadedly engaged to exterior threads 16 located at each end of the axle pin.

The ball bearing unit 12 is preferably conventional in design. The hex nuts 14 contact the bearing's inner race, but leave a space adjacent the bearing's outer race to thereby allow said outer race to spin freely. It should be noted that other types of rotatable units or members can be used in lieu of the ball bearing unit shown. Alternatively, the ball bearing unit can be dispensed with when the yo-yo's tether is attached directly to the axle pin, or to a structure fixedly secured to said pin, or to an equivalent structure that connects the side portions together.

Each side portion 2 includes a hub 20 (note FIGS. 1–4) that has an inwardly-facing surface 22, an outwardly-facing surface 24 and an outwardly-extending nipple portion 26. A thru-bore 28 extends through the center of the hub. A plurality of apertures 30 also extend through the hub and are located symmetrically about the hub's center. While eight apertures 30 are shown, the hub can have a greater or fewer number of apertures 30. In addition, while the apertures are shown in the form of circular holes, they may be elongated and/or be in the form of slot-like three-sided openings.

Preferably, the hub 20 is made of a rigid, or substantially rigid, plastic material. Alternatively, the hub can be made of other materials, including metal, wood, rubber or be a composite or assemblage of rigid and/or non-rigid parts.

The hub's inwardly-facing surface 22, which may also be referred to as a tether-facing surface, surrounds a circular cavity 32 having a hexagonally-shaped cavity 34 located at its center. Fixedly secured in cavity 34 is one of the hex nuts 14. Each of the hex nuts is preferably sized to create an interference fit with the walls of cavity 34 and is preferably pressed into the hub. Alternatively, other shapes or types of nuts, or other methods for securing said nuts, such as the use of adhesives or sonic welding, may be employed.

Each hub's nipple portion 26 has a circular cavity 36 in its distal end. The cavity is adapted to inwardly contain a bushing 38 made of nylon or some other deformable and/or resilient material. The bushing has a thru-bore 40 located at its center that may include internal threads (not shown). The exterior surface of the distal end of the nipple portion has threads 42.

Located adjacent the outwardly-facing surface 24 of each hub is a replaceable disk 50 (note FIGS. 1, 2, 5 and 6). Each replaceable disk includes an inwardly-facing surface 52, an outwardly-facing surface 54 and a center-located thru-hole 56. The thru-hole has a diameter slightly greater than that of the hub's nipple portion. The replaceable disk also includes at least one tether engagement member 58 that is preferably located proximate the center-located thru-hole 56. The disk can have as many members 58 as the hub has apertures 30.

The tether engagement member is in the form of an elongated cylinder having an end-located tether-facing surface 60 that may be smooth, or include one or more ribs/ridges that protrude in a direction toward said tether. Other known types of surface adaptations that facilitate tether engagement in yo-yos, such as indentations, spaced pads/protrusions, the use of a material, such as rubber, that has a high coefficient of friction, may also be simultaneously or alternatively employed on, or in, surface 60. The tether engagement member functions to provide a surface that the tether can contact to enhance the ability of the tether to become locked to the hubs. When the yo-yo is spinning, this type of locking engagement will result in the yo-yo returning to the user's hand.

The replaceable disk has an annular rim portion 62 and is preferably larger in diameter than the hub 20. As can be seen in FIG. 1, the shape of the disks' rim portions 62 primarily, or at least significantly, contribute to the shape of the yo-yo 1. While the disk 50 shown in the figures is a unitary part, said disk may include a separate rim portion that is bonded, or otherwise secured to, the disk's central portion 64. The replaceable disk is preferably made of a compressible, resilient material such as rubber, or a rigid plastic, metal or wood material. Alternatively, the disk can be made of semi-rigid plastic or equivalent materials, and may be a composite of all of said, or other, materials.

The outwardly-facing surface 54 of the replaceable disk preferably includes a plurality of outwardly-extending cylindrical alignment members 66. The members 66 are positioned in a circular array proximate the disk's thru-hole 56.

Located adjacent the outwardly-facing surface 54 of each replaceable disk is a support disk 68 (note FIGS. 1, 2, 7 and 8). The support disk features an inwardly-facing surface 70, an outwardly-facing surface 72 and a center-located thru-hole 74. The thru-hole has a diameter slightly greater than that of the hub's nipple portion. Surface 70 of the support disk preferably has a contour that is complementary to that of surface 54 of the replaceable disk and includes a ring of circular bores 76. The bores are complementary in shape to the replaceable disk's alignment members 66 and are located to inwardly receive said members. Located in the outwardly-facing surface of the support disk is at least one indentation 78. In the embodiment shown, a plurality of indentations 78 are positioned in a circular array. The support disk is preferably made of a rigid, or substantially rigid, plastic material.

Located adjacent the outwardly-facing surface 72 of the support disk is a securement member 80 (note FIGS. 1, 2, 9 and 10). The securement member includes an inwardly-facing surface 82, an outwardly-facing surface 84 and a center-located bore 86. The bore is of approximately the same diameter as the distal end of the hub's nipple portion and has interior threads 88 that are complementary to the threads 42 located on the exterior surface of said nipple portion.

The inwardly-facing surface 82 of the securement member includes at least one protuberance 90 that extends outwardly from said surface. In the embodiment shown, two protuberances 90 are employed. It should be noted that the indentations 78 of the support disk are complementary in shape and size to the protuberances 90 and are located at the same radial distance from the yo-yo's axis of rotation as said protuberances.

The outwardly-facing surface 84 of the securement member includes two shaped grooves/indentations 92. The indentations enhance a user's ability to grasp the outer surface of the securement member with his or her fingers and then to subsequently turn the securement member.

When a yo-yo 1 is assembled, the first step is to position the ball bearing unit 12 on the center of the axle pin 10. Next, the hubs 24 are threaded onto opposite ends of the axle pin via their hex nuts 14 engaging the axle pin's end-located threads 16. Each hub is rotated relative to the axle pin until its hex nut is proximate the ball bearing unit and the axle pin extends into the hub's bushing 38. The thru-bore 40 of each bushing 38 is sized whereby the threads 16 of the axle pin will deformably engage the bushing. This engagement acts to increase the torque required to rotate the side portion 2 relative to the axle pin and to the other side portion 2. This provides a mechanism for adjustable string gap in which one changes the width of the string gap area via a rotation of one side portion relative to the other side portion.

To finish the assembly of a side portion, the replaceable disk 50 is placed onto the side portion's hub 20, with the hub's nipple portion 26 fitting through the replaceable disk's thru-hole 56 and the replaceable disk's tether engagement member 58 fitting through one of the complementary apertures 30 in the hub. The tether engagement member extending through one of the replaceable disk's apertures acts to prevent the replaceable disk from rotating relative to the hub. While the end of the tether engagement member may be flush with, or slightly recessed in, the hub's tether-facing surface 22, it preferably protrudes slightly into the yo-yo's string gap area. In any of said positions, the end of the tether engagement member can, to some degree, function to facilitate the tether's ability to lock onto one of the yo-yo's side portions when a user tries to have the yo-yo return on command.

Once the replaceable disk is properly positioned, the support disk 68 is placed against the outwardly-facing surface 54 of the replaceable disk. This is accomplished by fitting the hub's nipple portion through the support disk's thru-hole 74 as the replaceable disk's alignment members 66 are received within the complementary bores 76 of the support disk. The alignment members being received within the bores prevents rotation of the support disk relative to the replaceable disk. It should be noted that the use of a support disk is optional.

The components of the side portion are then secured together using the securement member 80. The distal end of the hub's nipple portion is inserted into the center bore 86 of the securement member whereby the securement member's threads 88 engage threads 42 of the hub's nipple portion. The user then rotates the securement member, preferably by hand, in a direction that causes the securement member to move toward the support disk.

As soon as the securement member is rotated into contact with the support disk, a clicking noise will be heard. The noise is created as the securement member's protuberances 90 slide into the support disk's indentations 78. Each point at which the protuberances are received within indentations 78 functions as a detent in the form of a releasable locking engagement. Preferably, multiple indentations 78 are employed in a manner that provides multiple detent points per revolution of the securement member.

The user will preferably continue turning the securement member by hand until all of the components of the side portion are pressed together by the securement member, and the securement member is tight against the support disk. The final click provides a locking engagement that helps to prevent inadvertent loosening/rotation of the securement member. It should be noted that the support disk acts to distribute the inward force applied by the securement member over a large area of the replaceable disk. The support disk also prevents the rotative movement of the securement member from being applied directly against the possibly more fragile replaceable disk.

To disassemble either of the side portions of the yo-yo 1, one merely rotates the side portion's securement member in the opposite direction after overcoming the locking engagement between the securement member's protuberances and the support disk's indentations. Once the securement member is removed from the hub's nipple portion, the support disk and replaceable disk can then be removed from the hub.

Figure 12:
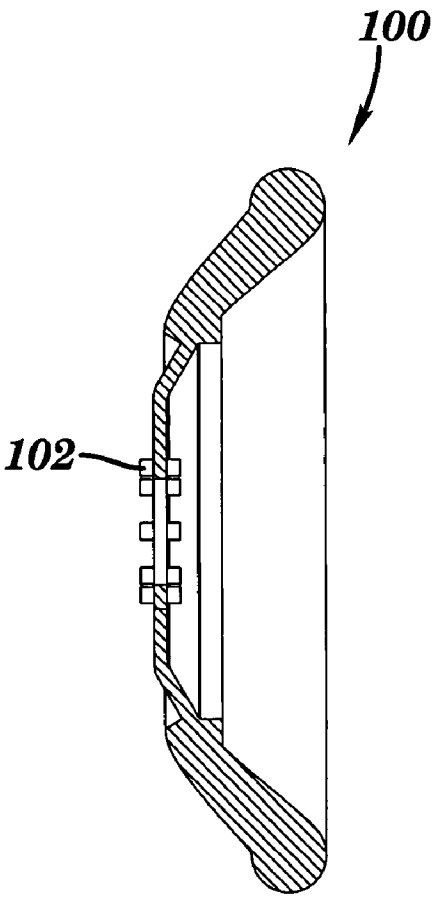
FIG. 12 is a cross-sectional view of a third embodiment of a replaceable disk in accordance with the invention.
Figure 11:
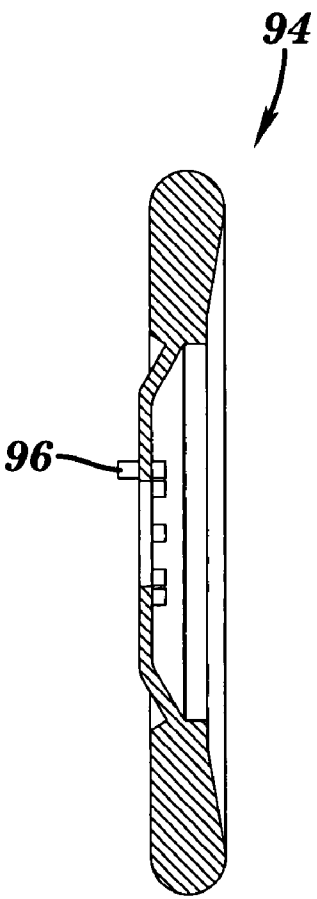
FIG. 11 is a cross-sectional view of a second embodiment of a replaceable disk in accordance with the invention.

The above procedure can enable a user to quickly and easily change the look and/or rim material and/or responsiveness of the side portions of yo-yo 1. For example, the yo-yo 1 is shown with replaceable disks 50 that provide the yo-yo with a diablo-type look and preferably a medium to high level of responsiveness. This configuration is optimal for the performance of many yo-yo tricks. When the replaceable disks 50 are made of a resilient material, the yo-yo 1 is thereby optimized for the performance of off-string tricks. When each of the replaceable disks 50 are replaced with a disk 94 per FIG. 11, the yo-yo will then have a conventional look in which the side portions are substantially planar and the longer tether engagement member 96 will provide the yo-yo with a high level of responsiveness. Alternatively, each replaceable disk 50 can be replaced by a replaceable disk 100 per FIG. 12. The yo-yo would then have a butterfly shape and have multiple tether engagement members 102 that are preferably not as long as the tether engagement member 58 of disk 50. In this manner, the tether engagement members would not protrude as far into the string gap area, thereby providing the yo-yo with a slightly lower level of responsiveness. The lower level of responsiveness, in combination with a butterfly shape, optimize the yo-yo for the performance of string tricks.

Furthermore, it is possible to change the yo-yo's responsiveness without changing the yo-yo's appearance. One can replace a set of disks 50 with another set of identical-looking disks 50 that are made of a smoother material that has a lower coefficient of friction. This will make the tether less prone to adhere to the tether-facing surface of the tether engagement members and thereby reduce the yo-yo's responsiveness.

Figure 13:
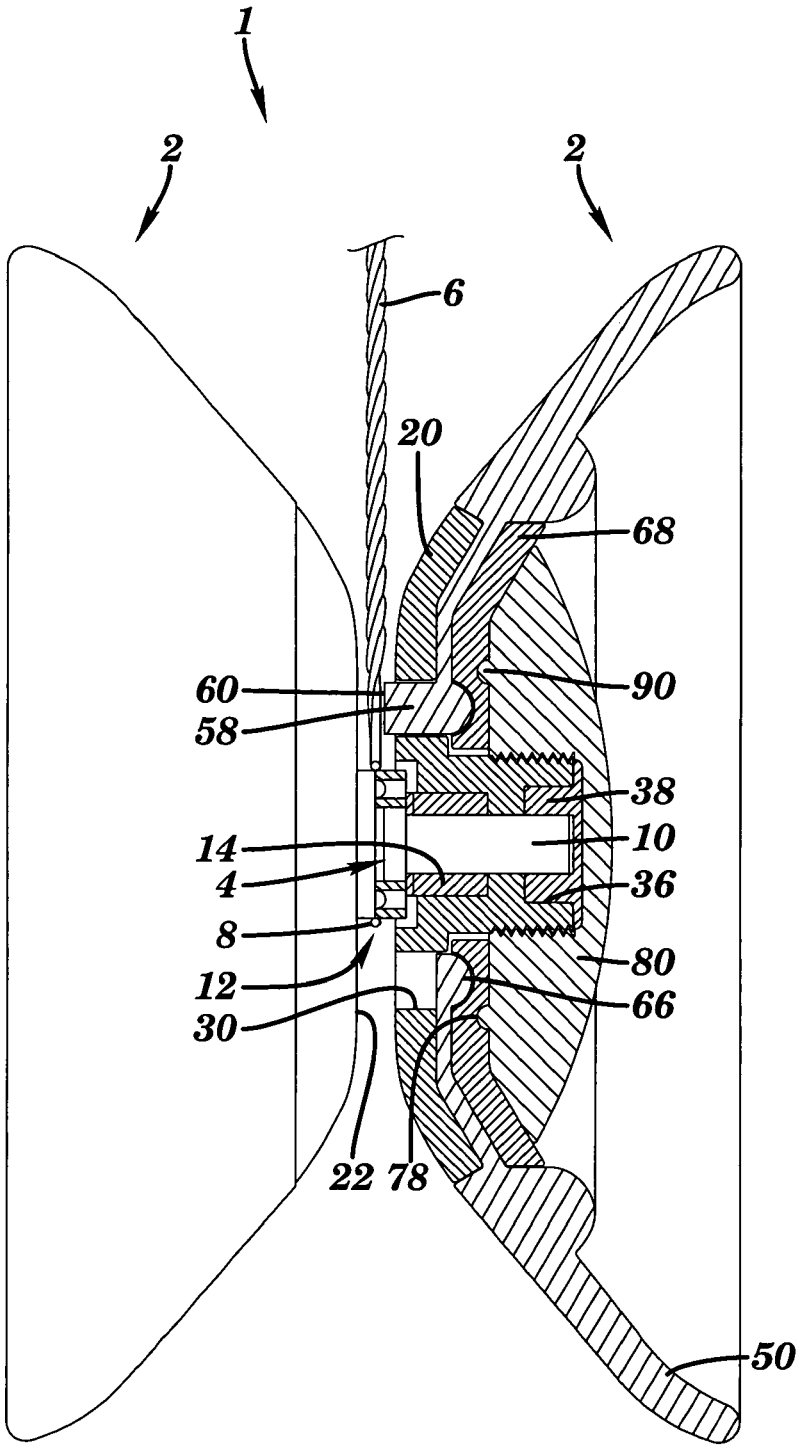
FIG. 13 is a front view of the same yo-yo shown in FIG. 1, but showing the result of further tightening of the yo-yo's securement members when the replaceable disks are made of a resilient material.

It should also be noted that when the replaceable disks 50, 94 or 100 are made of a resilient material such as rubber, a user can adjust the yo-yo's responsiveness via a tightening or loosening of one, or both, of the securement members 80. In FIG. 13, the yo-yo 1 is shown having replaceable disks 50 made of a resilient material and at a point after a user has tightened the securement members from their position per FIG. 1. Since each replaceable disk is compressible, further tightening of the securement members has caused the replaceable disks to be compressed, resulting in each disk's tether engagement member being somewhat extruded through the aperture 30 in the adjacent hub. This results in the tether engagement members extending further into the yo-yo's string gap area, which causes an increase in the yo-yo's responsiveness since the tether will have a shorter distance to travel in order to contact either tether engagement member.

Figure 14:
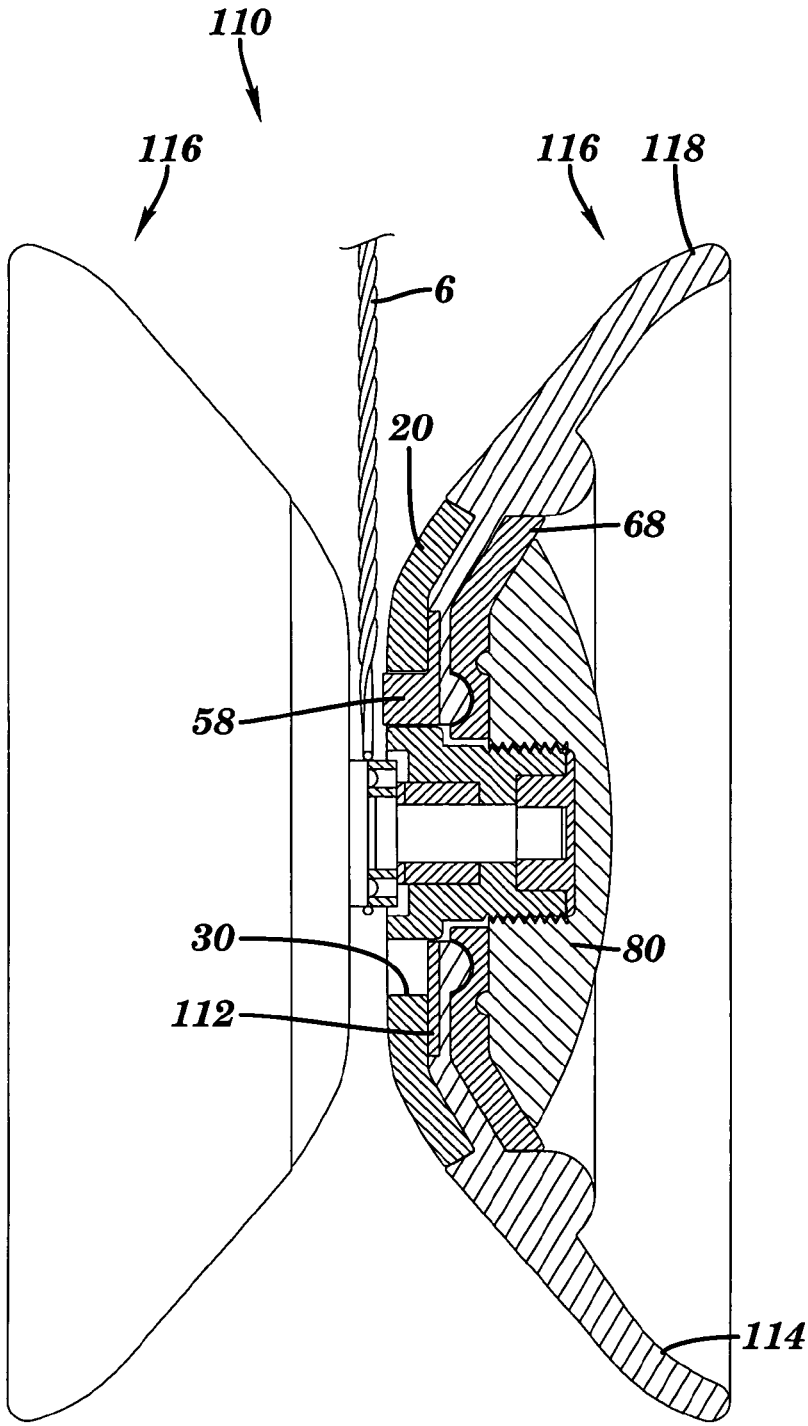
FIG. 14 is a front view of a second embodiment of a yo-yo in accordance with the invention, with the right-hand portion of the yo-yo shown in cross-section.

FIG. 14 shows a second embodiment of a yo-yo 110 in accordance with the invention. Yo-yo 110 has a replaceable engagement disk 112 sandwiched between the hub 20 and a replaceable rim disk 114. As in the first embodiment, each side portion 116 employs a support disk 68 and a securement member 80 to secure together the side portion's different parts.

The engagement disk 112 has an inwardly-extending tether engagement member 58 that extends through one of the apertures 30 in the hub 20. The disk is preferably similar to the center portion 64 of disk 50 and may similarly include one or more tether engagement members. Preferably, the disk is made of a compressible flexible, semi-rigid or rigid material.

The rim disk 114 has a rim portion 118 that forms a rim of the side portion and is preferably made of a plastic, metal, wood or rubber material that may be the same as, or different than, the material of the engagement disk. In a manner similar to that of the replaceable disk of the first embodiment, the rim disk may be in any of a number of shapes whereby a user can employ different sets of rim disks to cause the yo-yo 110 to have different shapes.

It should be noted that in this second embodiment of the invention, one has the option to not employ a rim disk and/or support disk whereby the securement member would press either indirectly, or directly, on the engagement disk. If a rim disk is not employed, either the periphery of the engagement disk, hub, support disk, or securement member can form the side portion's rim. If the engagement disk is made of a compressible material, changing the compression of the engagement disk via rotation of the securement member would change the yo-yo's responsiveness.

In either of the embodiments of the invention, one should note that one can change the responsiveness of the yo-yo by either aligning, or mis-aligning the tether engagement member(s) of one side portion relative to the tether engagement member(s) of the other side portion. When the tether engagement members face each other, the yo-yo responsiveness will be at its maximum. This effect is most pronounced when each of the two side portions has only a single tether engagement member.

It should also be noted that the fastening system, as taught herein, may be employed with other types of yo-yos than the ones shown. Furthermore, while only a few different replaceable disks have been shown and described, the replaceable disks used in the yo-yos 1 and 110 may have other shapes than those described herein. In addition, while the yo-yos shown have at least one replaceable disk in each of their side portions, it is within the scope of the invention whereby only one of the side portions may have a replaceable disk, and the other side portion could be a unitary part or have a fixed disk.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A yo-yo comprising:

first and second side portions secured together in a spaced-apart relation by an axle structure;

a tether secured to a portion of said axle structure;

a hub that forms a portion of said first side portion and includes a tether-facing surface; and a disk located adjacent said hub and secured to said hub, wherein said disk has a tether engagement member that forms an integral portion of said disk and extends through an aperture in said hub, wherein said member has an end portion that can be contacted by a portion of said tether located between said side portions, and wherein a portion of said disk at least partially forms a rim of the first side portion;

a user actuable member operatively connected to said disk and enables said tether engagement member to be adjustably positionable relative to the tether by causing the disk to be compressed which moves the tether engagement member closer to said tether.

2. The yo-yo of claim 1 wherein said disk is made of a resilient material.

3. The yo-yo of claim 1 wherein said disk is a first disk and wherein said yo-yo further comprises a second disk and a securement member, wherein said hub is located adjacent an inwardly-facing surface of the first disk, wherein second disk is located adjacent an outwardly-facing surface of the first disk, wherein said securement member is located adjacent an outwardly-facing surface of the second disk and is engaged to said hub in a manner that enables said securement member to secure the first and second disks to said hub.

4. The yo-yo of claim 3 wherein the first disk is engaged to said second disk in a manner that prevents the second disk from rotating relative to the first disk.

5. The yo-yo of claim 4 wherein a plurality of alignment members formed in said first disk are received within bores in said second disk.

6. The yo-yo of claim 3 wherein a string gap area is located between said side portions, wherein said first disk is made of a resilient material, wherein said engagement between said securement member and said hub is of a type whereby when said securement member is in a first position and said tether is fully extended, centered in said string gap area and taut, said tether engagement member will be located at a first distance relative to an adjacent portion of said tether, and wherein movement of said securement member to a second position can cause the first disk to be compressed in a manner whereby the tether engagement member moves through said hub to become located closer to said adjacent portion of said tether.

7. The yo-yo of claim 1 wherein the disk has a plurality of tether engagement members that extend through apertures in said hub.

8. The yo-yo of claim 7 wherein said apertures have a size and shape complementary to said tether engagement members.

9. The yo-yo of claim 1 further comprising a securement member that is spaced from said tether engagement member, and wherein said securement member is releasably engaged to said hub and functions to releasably secure said disk to said hub.

10. The yo-yo of claim 9 wherein said securement member is movable relative to the side portion's rim and is adapted to enable it to be easily grasped and rotated by hand.

11. The yo-yo of claim 9 wherein the securement member interacts with an adjacent portion of the first side portion to create a locking engagement of said securement member.

12. The yo-yo of claim 11 wherein when said securement member is rotated, an engagement between a portion of said securement member and an adjacent portion of the first side portion will produce an audible click when a locking engagement of the securement member occurs.

13. The yo-yo of claim 9 wherein said securement member is located adjacent a portion of the first side portion that has an outwardly-facing planar surface that includes a plurality of spaced-apart indentations and wherein an inwardly-facing surface of the securement member includes a protuberance and wherein rotation of said securement member can cause said protuberance to be received in one of said indentations to thereby create a locking engagement of said securement member with said adjacent portion of the first side portion.

14. The yo-yo of claim 1 wherein said hub includes a center-located nipple portion that extends through a center-located thru-hole in the disk.

15. The yo-yo of claim 14 wherein an end portion of said nipple portion includes exterior threads adapted to engage interior threads located in a bore of a securement member that functions to secure said disk to said hub.

16. The yo-yo of claim 1 wherein the disk includes a rim portion made of a flexible material.

17. The yo-yo of claim 1 wherein said hub includes a cavity that contains a bushing made of a deformable material, wherein said bushing contacts, and is deformed by, a threaded portion of an axle pin of the axle structure, wherein a width dimension of a space located between the first and second side portions can be changed by rotating one of said side portions relative to the other of said side portions, and wherein deformation of said bushing acts to bias said side portions against rotation relative to said axle pin.

18. The yo-yo of claim 1 wherein said second side portion is substantially identical to said first side portion.

19. A yo-yo comprising:

first and second side portions secured together in a spaced-apart relation by an axle structure, and wherein each of said side portions is an assemblage of parts;

a tether secured to a portion of said axle structure;

first and second hubs, wherein said first hub forms a portion of said first side portion and said second hub forms a portion of said second side portion, and wherein each of said hubs has a tether-facing surface;

first and second replaceable disks;

wherein said first replaceable disk is non-rotatably secured to said first hub, at least partially forms a rim portion of the first side portion, and has a tether engagement member that extends through an aperture in said first hub whereby an end of said tether engagement member can be contacted by a portion of said tether located between said side portions and is sized whereby it can slide completely through said aperture;

a user actuable member operatively connected to said first disk and enables said tether engagement member to be adjustably positionable relative to the tether by causing the disk to be compressed which moves the tether engagement member closer to said tether and wherein said second replaceable disk is non-rotatably secured to said second hub, at least partially forms a rim portion of the second side portion, and has a tether engagement member that extends through an aperture in said second hub whereby said tether engagement member can be contacted by a portion of said tether located between said side portions.

20. The yo-yo of claim 19 further comprising first and second securement members, wherein said first securement member forms a portion of said first side portion, is directly connected to a center-located, outwardly-extending portion of said first hub and is located to capture the first replaceable disk between itself and said first hub, and wherein said second securement member forms a portion of said second side portion, is operatively connected to said second hub and is located to capture the second replaceable disk between itself and said second hub.

21. The yo-yo of claim 19 wherein a user can change the shape of said first side portion by removing only the first replaceable disk and in its place installing a third replaceable disk that has a rim portion shaped differently than the rim portion of the first replaceable disk.

22. A yo-yo comprising:

first and second side portions secured together in a spaced-apart relation by an axle structure;

a tether secured to a portion of said axle structure;

a hub that forms a portion of said first side portion and includes a tether-facing surface;

a disk secured to said hub and having a fixedly-attached portion that forms a tether engagement member that extends through an aperture in said hub, and wherein said member has an end portion that can be contacted by a portion of said tether located between said side portions; and a securement member operatively engaged to said hub and that functions to secure said disk to said hub and that enables said tether engagement member to be adjustably positionable relative to the tether by causing the disk to be compressed which moves the tether engagement member closer to said tether.

23. The yo-yo of claim 22 wherein said disk is a first disk and wherein said yo-yo further comprises a second disk that at least partially forms the first side portion's rim and is sandwiched between the securement member and the first disk.

24. The yo-yo of claim 22 wherein a string gap area is located between said side portions, wherein said disk is made of a resilient material, wherein said securement member is engaged to said hub in a manner whereby when said securement member is in a first position and said tether is fully extended, centered in said string gap area and taut, said tether engagement member will be located at a distance relative to an adjacent portion of said tether, and wherein said securement member can then be moved to a second position that causes the first disk to be compressed in a manner whereby the tether engagement member moves closer to said adjacent portion of said tether whereby said distance is reduced.

25. A yo-yo comprising:

first and second side portions secured together in a spaced-apart relation by an axle structure;

a tether secured to a portion of said axle structure;

a hub that forms a portion of said first side portion; and a disk secured to said hub, wherein said disk has a tether engagement member that forms an integral portion of the disk and extends through an opening in said hub, wherein said member has an end portion that can be contacted by a portion of said tether located between said side portions, and wherein a portion of said disk at least partially forms a rim of the first side portion;

a user actuable member operatively connected to said disk and enables said tether engagement member to be adjustably positionable relative to the tether by causing the disk to be compressed which moves the tether engagement member closer to said tether.

26. The yo-yo of claim 25 wherein said disk is made of a resilient material, wherein a securement member is releasably engaged to said hub and functions to releasably secure said disk to said hub, wherein a string gap area is located between said side portions, wherein when said securement member is in a first position and said tether is fully extended, centered in said string gap area and taut, said tether engagement member will be located at a first distance relative to an adjacent portion of said tether, wherein moving said securement member to a second position can cause the disk to be compressed in a manner whereby the tether engagement member moves so that it is at a second distance relative to said adjacent portion of said tether, and wherein said second distance is less than said first distance.

27. The yo-yo of claim 1 wherein said tether engagement member protrudes outwardly from a tether-facing, planar surface of said hub.

28. The yo-yo of claim 22 wherein the axle structure includes an axle member that has a longitudinal axis and wherein the securement member is engaged to a portion of said hub that is located closer to said axle member's longitudinal axis than said tether engagement member.

* * * * *